US008383201B2

(12) United States Patent
Berry et al.

(10) Patent No.: US 8,383,201 B2
(45) Date of Patent: Feb. 26, 2013

(54) METHOD AND APPARATUS FOR COATING A THIN FILM SUBSTRATE

(75) Inventors: Craig J. Berry, Westport, CT (US); Walter Klauser, Ringwood, NJ (US); George Stephens, Hewitt, NJ (US)

(73) Assignee: Acupac Packaging, Inc., Mahwah, NJ (US)

( * ) Notice: Subject to any disclaimer, the term of this patent is extended or adjusted under 35 U.S.C. 154(b) by 584 days.

(21) Appl. No.: 11/846,871

(22) Filed: Aug. 29, 2007

(65) Prior Publication Data

US 2008/0057201 A1 Mar. 6, 2008

Related U.S. Application Data

(60) Provisional application No. 60/823,851, filed on Aug. 29, 2006.

(51) Int. Cl.

| | |
|---|---|
| ***B05D 7/00*** | (2006.01) |
| ***B05D 1/26*** | (2006.01) |
| ***B05D 1/36*** | (2006.01) |

(52) U.S. Cl. ..... 427/258; 427/286

(58) Field of Classification Search ..... 427/256, 427/258, 261, 286, 420; 118/323; 426/89, 426/274, 416

See application file for complete search history.

(56) References Cited

U.S. PATENT DOCUMENTS

| | | | | |
|---|---|---|---|---|
| 3,381,337 | A * | 5/1968 | Hureau | 425/381 |
| 6,824,829 | B2 * | 11/2004 | Berry et al. | 427/372.2 |
| 7,241,411 | B2 * | 7/2007 | Berry et al. | 264/160 |
| 7,910,641 | B2 * | 3/2011 | Myers | 524/28 |
| 2005/0208108 | A1 * | 9/2005 | Jannusch et al. | 424/443 |
| 2008/0149121 | A1 * | 6/2008 | Wrenn et al. | 131/352 |
| 2008/0152695 | A1 * | 6/2008 | Clark et al. | 424/439 |

OTHER PUBLICATIONS

Reddding, M., "New Formulations: Dissolvable Film Deliver," Cosmetic & Personal Care Packaging Magazine, Sep. 2005, 2 pages.*

* cited by examiner

*Primary Examiner* — William Phillip Fletcher, III
(74) *Attorney, Agent, or Firm* — Ziegler IP Law Group, LLC

(57) ABSTRACT

A method including passing a substrate by at least one slot die in at least a first direction and applying at least one coating to the substrate with the slot die, where the slot die is moved in a direction transverse to the at least first direction.

7 Claims, 3 Drawing Sheets

METHOD AND APPARATUS FOR COATING A THIN FILM SUBSTRATE

CROSS-REFERENCE TO RELATED APPLICATIONS

This application claims the benefit of and priority to U.S. Provisional Patent Application No. 60/823,851 filed on 29 Aug. 2006.

BACKGROUND

1. Field

The present embodiments relate to coating webs of material and, more particularly, to slot die coating.

2. Brief Description of Related Developments

Currently the coating a web of material or substrate, such as a release liner, cloth, edible films, metals, or any other open or closed films or materials with a slot die is limited to a straight line on the substrate. The substrate is passed under or next to a stationary slot die so as the substrate passes the slot die straight lines of coating material are applied on the substrate producing a linear pattern in the direction of travel of the substrate.

It would be advantageous to coat a substrate with a slot die so nonlinear patterns can be created on the substrate where the pattern traverses the direction of travel of the substrate.

SUMMARY

In one aspect the disclosed embodiments are directed to an apparatus. In one embodiment the apparatus includes a frame, an anvil member connected to the frame and at least a one slot die connected to the frame, the slot die being configured to move transversely to a direction of travel of a substrate passing over the anvil member for applying at least one coating to the substrate.

In one aspect the disclosed embodiments are directed to a film coating device. In one embodiment the film coating device includes a frame, an anvil member connected to the frame, at first slot die connected to the frame, the first slot die being configured to move transversely to a direction of travel of a film passing over the anvil member for applying at least a first coating to the film and a second slot die connected to the frame, the second slot die being configured to move independently of the first slot die and in a direction transverse to the direction of travel of the film for applying at least a second coating to the film.

In one aspect the disclosed embodiments are directed to an method. In one embodiment the method includes passing a substrate by at least one slot die in at least a first direction and applying at least one coating to the substrate with the slot die, where the slot die is moved in a direction transverse to the at least first direction.

BRIEF DESCRIPTION OF THE DRAWINGS

The foregoing aspects and other features of the present embodiments are explained in the following description, taken in connection with the accompanying drawings, wherein.

DETAILED DESCRIPTION OF THE EXEMPLARY EMBODIMENT(S)

Figure 1A:
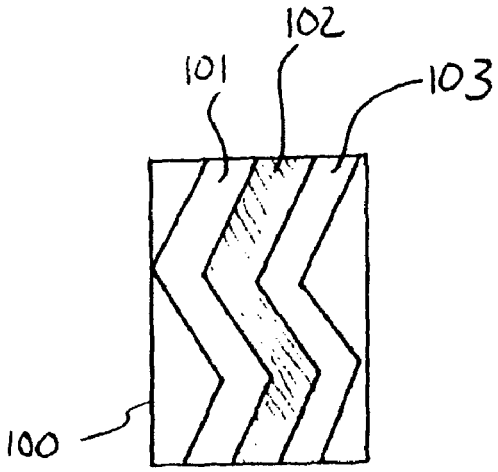
FIGS. 1A and 1B illustrate a coating on a substrate in accordance with an embodiment.
Figure 1B:
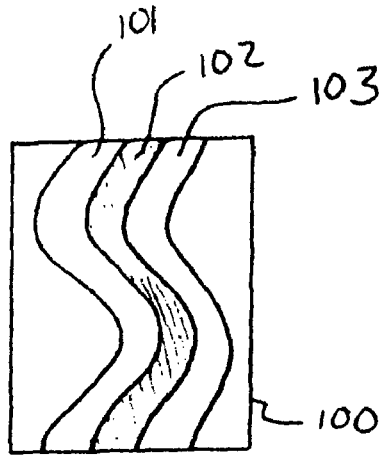

FIGS. 1A and 1B illustrate a coating on a substrate in accordance with an exemplary embodiment. Although aspects of the invention will be described with reference to the exemplary embodiments shown in the drawings and described below, it should be understood that those aspects could be embodied in many alternate forms of embodiments. In addition, any suitable size, shape or type of elements or materials could be used.

As can be seen in FIGS. 1A and 1B a substrate 100 is coated with at least one coating. The substrate 100 may be any suitable substrate such as, for example, cloth, edible and/or dissolvable films, metallic strips, or any other open or closed films. In the case of, for example, the edible and/or dissolvable films, the films may be affixed to any suitable release liner or non-woven material. In FIG. 1A and 1B the substrate is coated with three suitable coatings 101, 102, 103. In alternate embodiments any suitable number of coatings may be applied to the substrate 100. Each of the coatings 101, 102, 103 may have the same characteristics or each of them may have different characteristics or any combination thereof. For example, coating 101 may be red, coating 102 may be green, and coating 103 may be blue. In alternate embodiments the coatings 101, 102, 103 may have the same or different flavors. It is noted that the different colors and flavors are used for exemplary purposes only and that the coatings may have any suitable characteristics or combinations of characteristics, including but not limited to flavor, smell, thickness, color, texture and medicinal characteristics. In one embodiment, the medicinal characteristics of the coatings 101, 102, 103 may treating medical conditions such as allergies, colds, headaches, bad breath or any other ailment.

Figure 7:
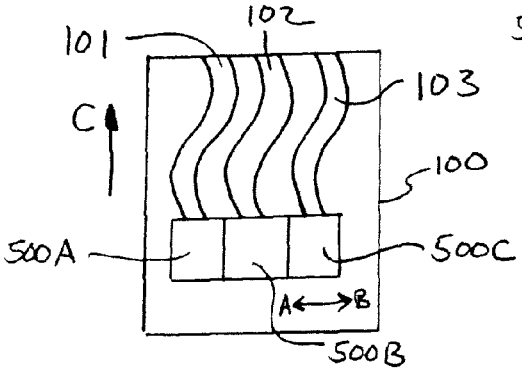
FIG. 7 illustrates an apparatus for coating a substrate in accordance with an embodiment.

As can be seen in FIGS. 1A and 1B the coatings 101, 102, 103 may be applied to the substrate 100 in a nonlinear fashion such as the zig-zag pattern in FIG. 1A or the wave pattern in FIG. 1B. In alternate embodiments, the coatings may be applied in a linear fashion. In still other alternate embodiments the coatings may be applied in both (i.e. a combination of) a linear and non-linear fashion. The coatings 101, 102, 103 may be applied to the substrate 100 with for example, a coating machine having multiple slot dies 500A, 500B, 500C mounted to a movable carriage as can be seen in FIG. 7. In alternate embodiments, a single slot die capable of applying multiple strips of coating may be used. During the coating process the slot dies 500A-500C may move transversely to the direction of the substrate travel C such as, for example, in the direction of arrows A, B to form, for example, the patterns shown in FIGS. 1A and 1B. In alternate embodiments, any suitable number of slot dies may be utilized to produce a pattern having any suitable number of coated nonlinear or linear lines. In alternate embodiments, the coatings 101, 102,

103 may be applied in layers (e.g. through three separate coating machines or three separate passes under a single slot die).

Figure 8:
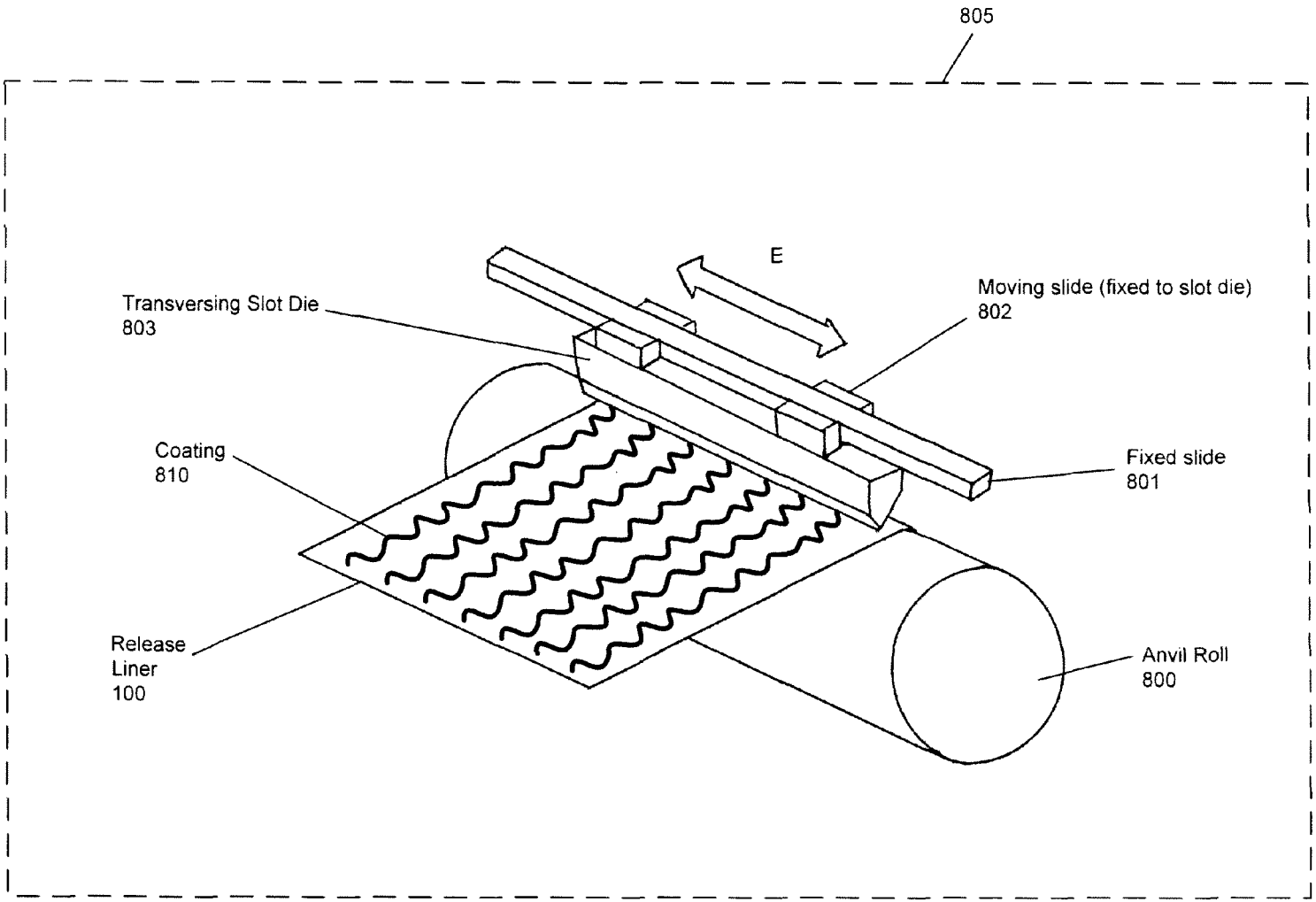
FIG. 8 illustrates an apparatus for coating a substrate in accordance with an embodiment.

Referring to FIG. 8, a coating machine in accordance with an embodiment is shown. The coating machine may include, an anvil roll 800, a fixed slide or guide rail 801, a moving slide 802 and a slot die 801, which are all supported a frame 805. The slot die 802 may be attached to at least one moving slide or carriage. In alternate embodiments, the slot die and the moving slide(s) may be of unitary construction. The moving slide/slot die assembly may be slidably mounted to a fixed slide 801. The fixed slide may be mounted, to for example, a frame, so that the fixed slide 801 runs parallel to the axis of rotation of the anvil roll 800 so that the slot die/moving slide assembly substantially traverses back and forth along the length of the anvil roll 800 in the direction of arrow E. The slot die/moving slide assembly may be driven in any suitable manner such as by, for example, a belt, chain, screw, electromagnets or any other suitable drive mechanism. As described above, the slot die may apply a coating 810 to a release liner or substrate 100 that may be drawn over or driven, at least partially, by the anvil roll 800. The slot die may move back and forth to provide any suitable pattern on the substrate 100 such as, for example, the wave pattern shown in FIG. 8. In FIG. 8, the coating is shown as being applied in multiple strips of coating 810. In alternate embodiments a single strip or any suitable number of strips of coating each having any suitable width may be applied to the substrate 100.

Figure 2A:
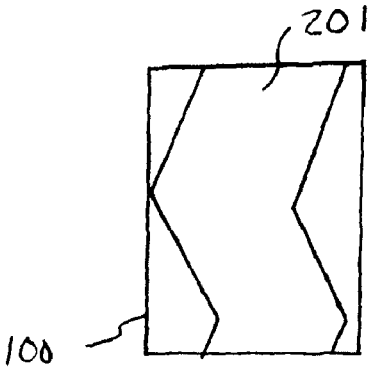
FIGS. 2A and 2B illustrate a coating on a substrate in accordance with another embodiment.
Figure 2B:
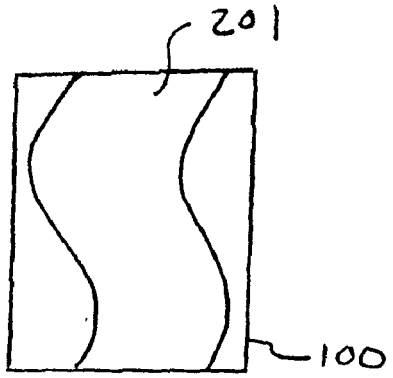
Figure 5:
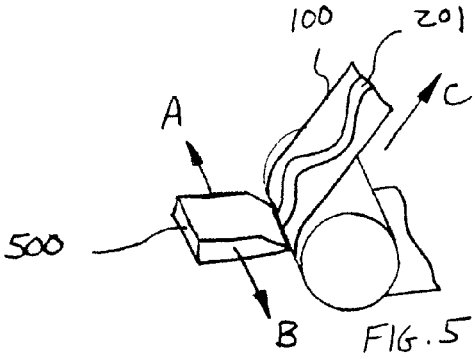
FIG. 5 illustrates an apparatus for coating a substrate in accordance with an embodiment.

Referring to FIGS. 2A and 2B the substrate 100 is coated with a single coating 201 in a zig-zag pattern as shown in FIG. 2A and a wave pattern as shown in FIG. 2B. In this example, a coating process having a single slot die may be utilized as can be seen in FIG. 5. In FIG. 5, the slot die 500 may be moved transversely to the direction of the substrate travel C such as, for example, in the direction of arrows A and B to form the zig-zag and wave patterns of FIGS. 2A and 2B.

Figure 3A:
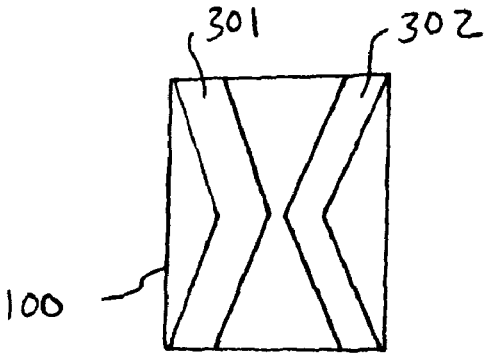
FIGS. 3A and 3B illustrate a coating on a substrate in accordance with an embodiment.
Figure 3B:
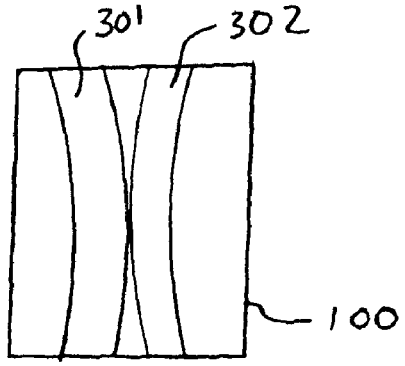
Figure 6:
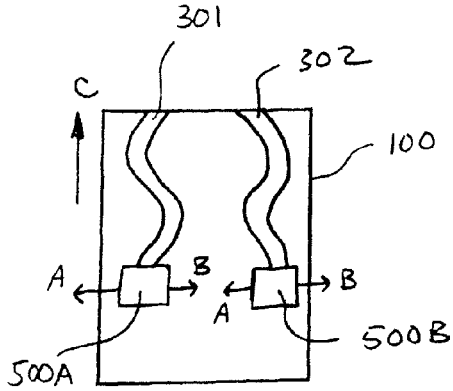
FIG. 6 illustrates an apparatus for coating a substrate in accordance with another embodiment.

As can be seen in FIGS. 3A and 3B the different coatings 301, 302 are applied to the substrate 100 in zig-zag (FIG. 3A) and wave or arced patterns (3B). However, in this example the zig-zags and waves are opposing each other whereas in FIGS. 1A and 1B the zig-zags and waves are uniform or flow in the same directions. In this example the coatings 301, 302 may be applied in a coating process having two slot dies 500A, 500B as can be seen in FIG. 6. In alternate embodiments any suitable number of slot dies may be utilized. Each of the slot dies may be mounted on a separate moving slide or carriage so that each slot die can move individually in the direction of arrows A, B and transversely to the direction of movement C of the substrate. In alternate embodiments, any suitable number of slot dies may be mounted on the coating machine to produce any suitable number of coating lines (i.e. coating lines 301, 302). In other alternate embodiments the coatings 301, 302 may be applied through a single slot die in layers where for example coating 301 is applied first and then the substrate 100 is passed under the slot die a second time to produce coating 302.

Figure 4A:
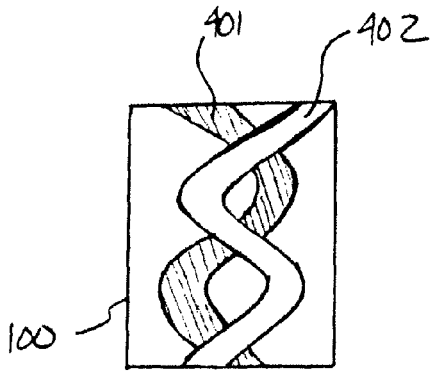
FIGS. 4A and 4B illustrate a coating on a substrate in accordance with an embodiment.
Figure 4B:
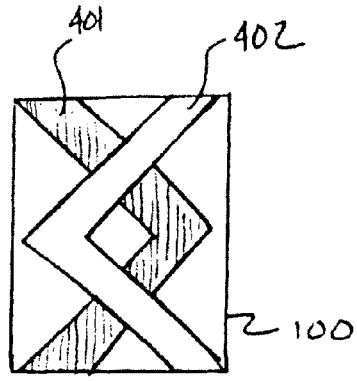

Referring to FIGS. 4A and 4B, the substrate 100 may be coated in, for example, layers to form complex patterns such as the helix pattern of FIG. 4A or the overlapping zig-zag pattern of FIG. 4B. In alternate embodiments, the coatings such as, for example, coatings 401, 402 may be applied to the substrate using a coating process having multiple slot dies capable of individual movement as described above. The slot dies may be placed side by side or one in front of the other which may allow the patterns produced by each slot die to overlap to form, for example, the complex helical patterns of FIGS. 4A and 4B.

Figure 9:
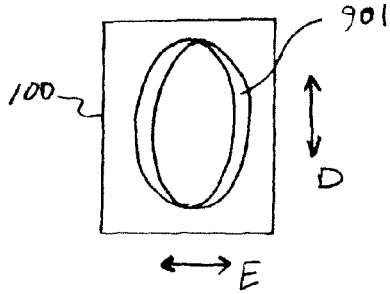
FIG. 9 illustrates a coating on a substrate in accordance with an embodiment.

Referring to FIG. 9, even more complex patterns may be produced using aspects of the disclosed embodiments. In the exemplary embodiment shown in FIG. 9, the coating may be applied to the substrate 100 in the shape of a circle 901. For example, the slot die may move back and forth in the direction of arrow E while the substrate moves back and forth in the direction of arrow D. Movement of both the slot die and the substrate 100 relative to each other may allow the production of any pattern or shape such as, for example, letters, words, drawings, etc. The coatings may also be applied in layers to produce even more complex patterns.

It should be realized that any number of slot dies may be utilized in the coating process. In addition, the speeds at which the slot dies and/or the substrate are moved can be varied to produce sharper angles, arcs and the like. It should also be realized that the disclosed embodiments are not limited to slot dies and that the aspects of the embodiments disclosed herein may be applied to any suitable coating process.

It should be understood that the foregoing description is only illustrative of the embodiments. Various alternatives and modifications can be devised by those skilled in the art without departing from the embodiments. Accordingly, the present embodiments are intended to embrace all such alternatives, modifications and variances that fall within the scope of the appended claims.

What is claimed is:

1. A method comprising:

providing a dissolvable and edible thin film substrate, the dissolvable and edible substrate being affixed to a release liner or non-woven material;

passing the substrate by at least one slot die attached to a movable carriage in at least a first direction; and applying a first coating to a first area of the substrate with the slot die, where the slot die is moved in a direction transverse to the at least first direction; and applying a second coating to a second area of the substrate different from the first area, both the first coating and second coating being applied to the substrate in a substantially non-linear fashion.

2. The method of claim 1 where the at least one slot die comprises at least two slot dies, the method further comprising independently moving the at least two slot dies transversely to the at least first direction for applying at least the first and second coating.

3. The method of claim 2, wherein the at least two slot dies are moved in opposite directions.

4. The method of claim 1, wherein each of the first coating and the second has a different characteristic, where the different characteristic includes one or more of a color, flavor, smell, thickness, texture and medicinal characteristics.

5. The method of claim 1, wherein the first coating is applied to the substrate in a pattern, the pattern comprising one or more of a letter, word, drawing, zig-zag pattern, arcuate pattern, overlapping pattern or helix pattern.

6. The method of claim 1, further comprising passing the substrate coated with the first coating by the at least slot die in the first direction a second time, the coated substrate being coated with the second coating in a second transverse direction, the second transverse direction being different than the transverse direction of the first coating.

7. The method of claim 1, comprising moving the slot die in a first transverse direction for a first predetermined time period, moving the slot dies in at least a second transverse direction for a second predetermined time period at the expiration of the first predetermined time period, and continuously repeating the movement of the slot die in the first transverse direction and the second transverse direction as the substrate moves by the slot die.

* * * * *